US007769317B2

(12) United States Patent
Ito

(10) Patent No.: US 7,769,317 B2
(45) Date of Patent: Aug. 3, 2010

(54) DEVELOPING DEVICE, PROCESS CARTRIDGE, IMAGE FORMING DEVICE AND DEVELOPER CONTAINER

(75) Inventor: Isao Ito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/370,060

(22) Filed: Feb. 12, 2009

(65) Prior Publication Data

US 2010/0046981 A1 Feb. 25, 2010

(30) Foreign Application Priority Data

Aug. 20, 2008 (JP) ..... 2008-211788

(51) Int. Cl.
*G03G 15/08* (2006.01)

(52) U.S. Cl. ..... 399/106

(58) Field of Classification Search ..... 399/106, 399/109

See application file for complete search history.

(56) References Cited

U.S. PATENT DOCUMENTS 6,760,556 B2 * 7/2004 De Kesel et al. ..... 399/106
6,842,595 B1 * 1/2005 McIver et al. ..... 399/106
7,277,659 B2 * 10/2007 Kobayashi et al. ..... 399/106

FOREIGN PATENT DOCUMENTS

| | | |
|---|---|---|
| JP | 07-168444 | 7/1995 |
| JP | 09-026743 | 1/1997 |
| JP | 2001-125357 | 5/2001 |

* cited by examiner

*Primary Examiner*—Hoang Ngo
(74) *Attorney, Agent, or Firm*—Morgan, Lewis & Bockius LLP

(57) ABSTRACT

A developing device includes: a housing having an opening; a sheet member provided on the housing and sealing the opening when not used, the sheet member including a forward part and a backward part, the forward part extending from a base end to a folded part, and the backward part extending in the one direction from the folded part to a free end as a top end of the sheet member; and a press unit pressing the backward part of the sheet member toward the forward part when not used, wherein the housing has a guide hole formed in a position where the backward part gradually separates off from the forward part and from the folded part to the free end, the backward part being inserted into the guide hole when not used, and the sheet member being guided by the guide hole when the sheet member is pulled out.

9 Claims, 11 Drawing Sheets

DEVELOPING DEVICE, PROCESS CARTRIDGE, IMAGE FORMING DEVICE AND DEVELOPER CONTAINER

CROSS-REFERENCE TO RELATED APPLICATIONS

This application claims priority under 35 USC 119 from a Japanese patent application No. 2008-211788 filed on Aug. 20, 2008.

BACKGROUND

1. Technical Field

The present invention relates to a developing device, a process cartridge, an image forming device, and a developer container.

2. Related Art

In recent years, a large number of recording devices/printers utilizing electrophotographic principles, with improved operationality have been introduced in the market. These improved devices are provided with a cartridge (a so-called process cartridge), which integrates members for executing an electrophotographic process.

Further, components constituting such a process cartridge are improved to meet demands for downsizing of recording devices. One such component is a developing device. In the developing device, a developer container part is formed in advance. The developer in the developer container part is transported outside through an outlet opening.

SUMMARY

According to one aspect of the invention, a developing device includes: a housing having a developer container part and an opening, the developer container part containing a developer, and the opening allowing the developer to flow through; a developer carrier that is rotatably attached to the housing, and holds and carries the developer contained in the developer container part to a developing area facing the image carrier; a sheet member that is provided on the housing and seals the opening when not used, and is pulled out in one direction to open the opening when used, the sheet member being folded back toward the opening and sealing the opening, the sheet member including a forward part and a backward part, the forward part extending from a base end to a folded part of the sheet member, and the backward part extending in the one direction from the folded part to a free end as a top end of the sheet member, protruding to the outside of the housing; and press unit that presses the backward part of the sheet member toward the forward part when not used, wherein the housing has a guide hole, the guide hole being formed in a position of the housing where the backward part of the sheet member gradually separates off from the forward part and from the folded part to the free end, the backward part of the sheet member being inserted into the guide hole when not used, and the sheet member being guided by the guide hole when the sheet member is pulled out.

BRIEF DESCRIPTION OF THE DRAWINGS

An exemplary embodiment of the present invention will be described in detail based on the following figures, wherein.

DETAILED DESCRIPTION

1. Whole Structure of Image Forming Device

Figure 1:
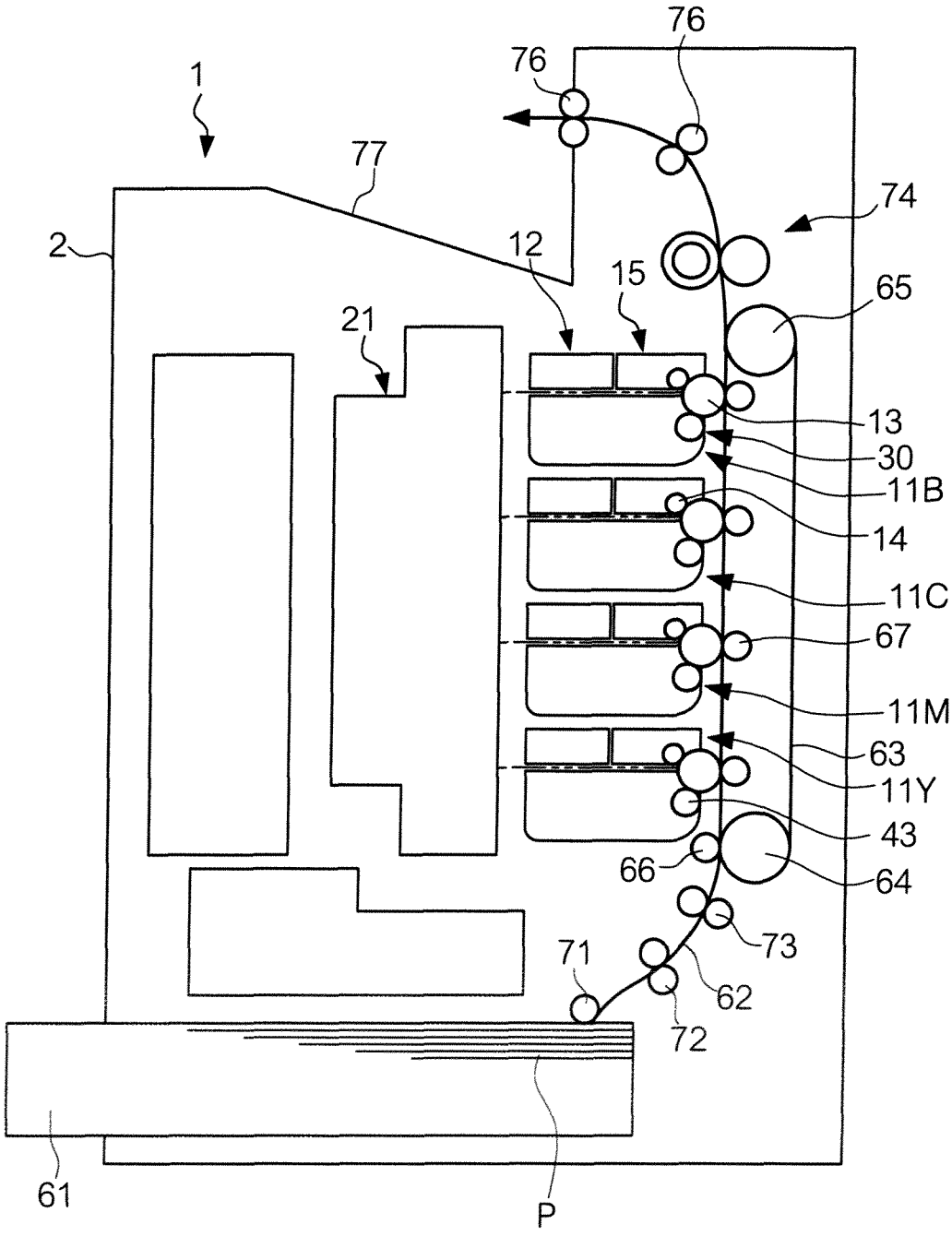
FIG. 1 shows a whole structure of an image-forming device according to an exemplary embodiment of the invention.

FIG. 1 shows a whole structure of an image-forming device in which a developing device according to the exemplary embodiment is used.

The image-forming device is a color image-forming device of a so-called tandem type. In a device housing 2, image-forming units 11 (e.g. 11Y, 11M, 11C, and 11B) for four colors (yellow, magenta, cyan, and black in this exemplary embodiment) are arrayed in a longitudinal direction. Below the image-forming units 11, there is provided a sheet feed cassette 61, which contains paper sheets P to be supplied. Through positions corresponding to the image-forming units 11, a sheet conveyance path 62 is set extending in a longitudinal direction, and serves as a route for conveying the paper sheets P from the sheet feed cassette 61.

The image-forming units 11 function to form toner images for yellow, magenta, cyan, and black colors, in an order from an upstream side of the sheet conveyance path 62. Each of the image-forming units 11 has a process cartridge and an exposure device 21. Various process units are built into the process cartridge 12, and the exposure device 21 illuminates the process cartridge 12 with scanning light for forming images.

The process cartridge 12 integrates, into one cartridge, a photo-sensitive drum 13, an electric charge roll 14, a developing device 30, and a cleaning device 15. The electric charge roll 14 electrically charges the photo-sensitive drum 13 in advance. The developing device 30 visualizes an electrostatic latent image by a color toner (having a negative polarity in this exemplary embodiment), wherein the electrostatic latent image has been exposed and formed on the electrically charged photo-sensitive drum 13 by the exposure device 21. The cleaning device 15 removes a waste toner on the photo-sensitive drum 13. The developing device 30 is detachably attached to a base of the process cartridge 12 (not shown in the figures).

Meanwhile, the exposure device 21 has a semiconductor laser, a polygon mirror, an imaging lens, and a mirror, which are contained in a casing. A light beam from the semiconductor laser is deflected by the polygon mirror, so as to scan exposure points on the photo-sensitive drum 13 by guiding a light image through the imaging lens and the mirror.

Further, a conveyor belt 63 which circulates and moves along the sheet conveyance path 62 is provided and extends through positions corresponding to the photo-sensitive drums 13 of the image forming units 11. The conveyor belt 63 is made of a belt material (rubber or resins) capable of electrostatically attracting a paper sheet P, and is wound between a pair of tension rolls 64 and 65.

A sheet attraction roll 66 is provided at a start position of the conveyor belt 63 (i.e., a position opposite the tension roll 64). As a high attraction voltage is applied to the sheet attraction roll 66, a paper sheet P is attracted by the conveyor belt 63. Transfer rolls 67 are provided on the back surface side of the conveyor belt 63, respectively corresponding to the photo-sensitive drums 13 of the image-forming units 11. The photo-sensitive drums 13 and the paper sheet P on the conveyor belt 63 are kept in tight contact with each other by the transfer rolls 67. Further, a predetermined transfer bias is applied between the transfer rolls 67 and the photo-sensitive drums 13 by a transfer bias power supply.

Further, the sheet feed cassette 61 is provided with a pickup roll 71 which feeds out paper sheets P each at predetermined timing, and feeds the paper sheets P through a conveyor roll 72 and a registration roll 73 to transfer positions.

A fixing device 74 is provided on the sheet convey path 62, at a position in a further downstream side of the image-forming unit 11B which exists in the most downstream side among the image-forming units 11. Plural sheet output rolls 76 for outputting paper sheets are provided in the downstream side of the fixing device 74. Paper sheets are output and stored in a container part 77 formed above the device housing 2.

In the image-forming device configured as described above, image formation is carried out through a process as follows.

In each of the image-forming units 11 (11Y, 11M, 11C, and 11B), the electric charge roll 14 electrically charges the photo-sensitive drum 13, and a latent image is formed on the photo-sensitive drum 13 by the exposure device 21. Thereafter, a visible image (toner image) is formed by the developing device 30.

Meanwhile, a paper sheet P is fed out at predetermined timing by the pickup roll 71 and is fed to an attraction position of the conveyor belt 63 through the conveyor roll 72 and the registration roll 73. The paper sheet P attracted by the conveyor belt 63 is then fed to transfer positions.

Toner images on the photo-sensitive drums 13 of the image forming units 11 are sequentially transferred to the paper sheet P by the transfer rolls 67. Toner images for respective color components on the paper sheet P are then fixed by the fixing device 74, and the paper sheet P subjected to the fixing of the toner images is then output to the container unit 77.

2. Outline of Process Cartridge

The process cartridge 12 has a photo-sensitive drum 13, an electric charge roll 14, a developing device 30, and a cleaning device 15.

3. Outline of Developing Device

Figure 2:
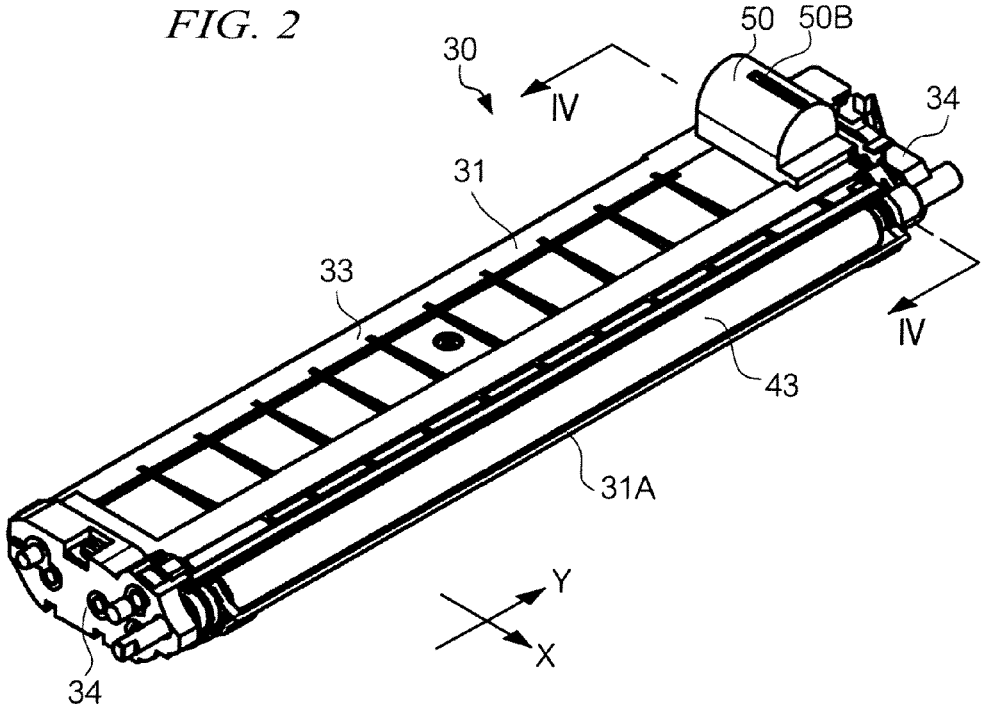
FIG. 2 is a perspective view showing a developing device according to the exemplary embodiment.
Figure 3:
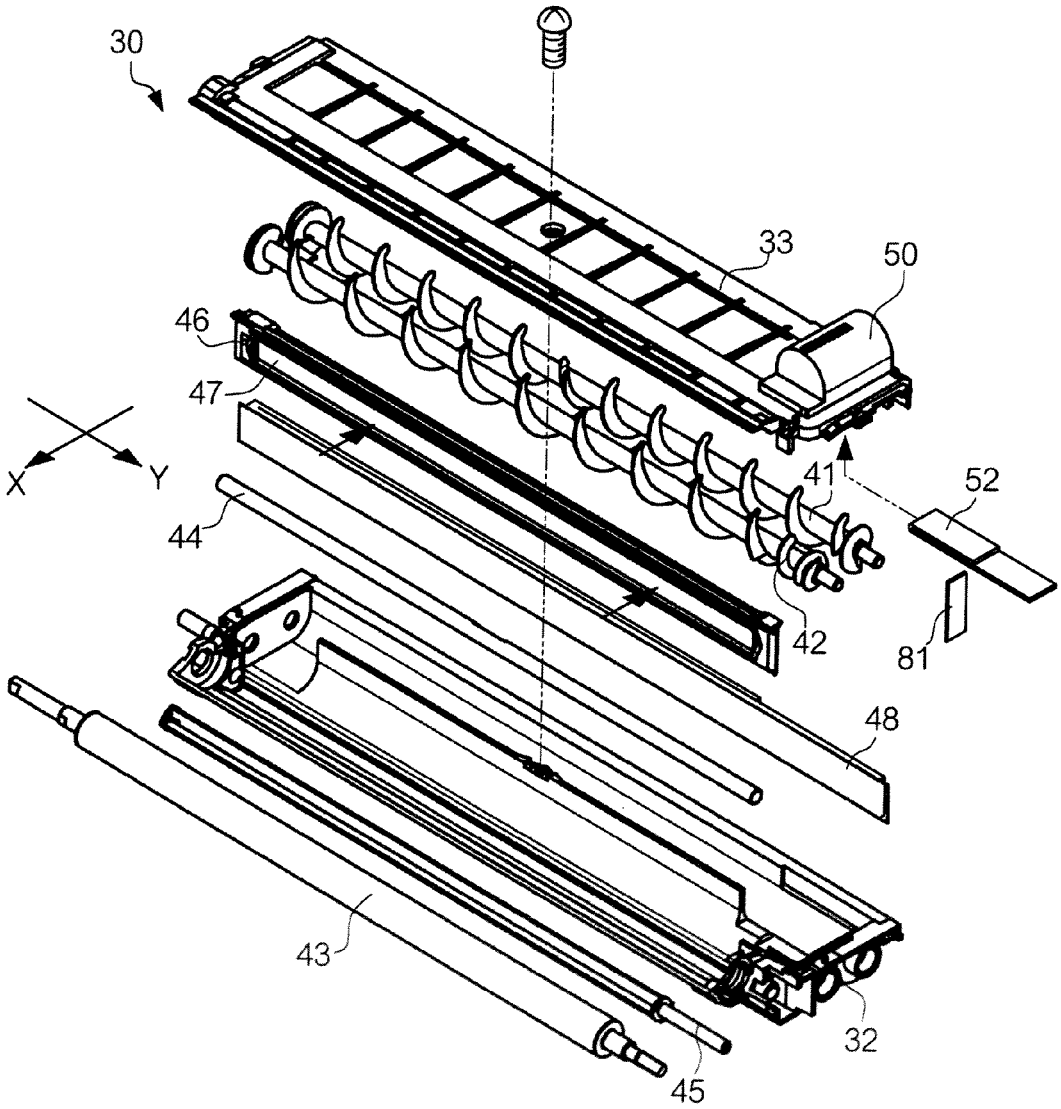
FIG. 3 is an exploded perspective view showing a main part of the developing device according to the exemplary embodiment.
Figure 4:
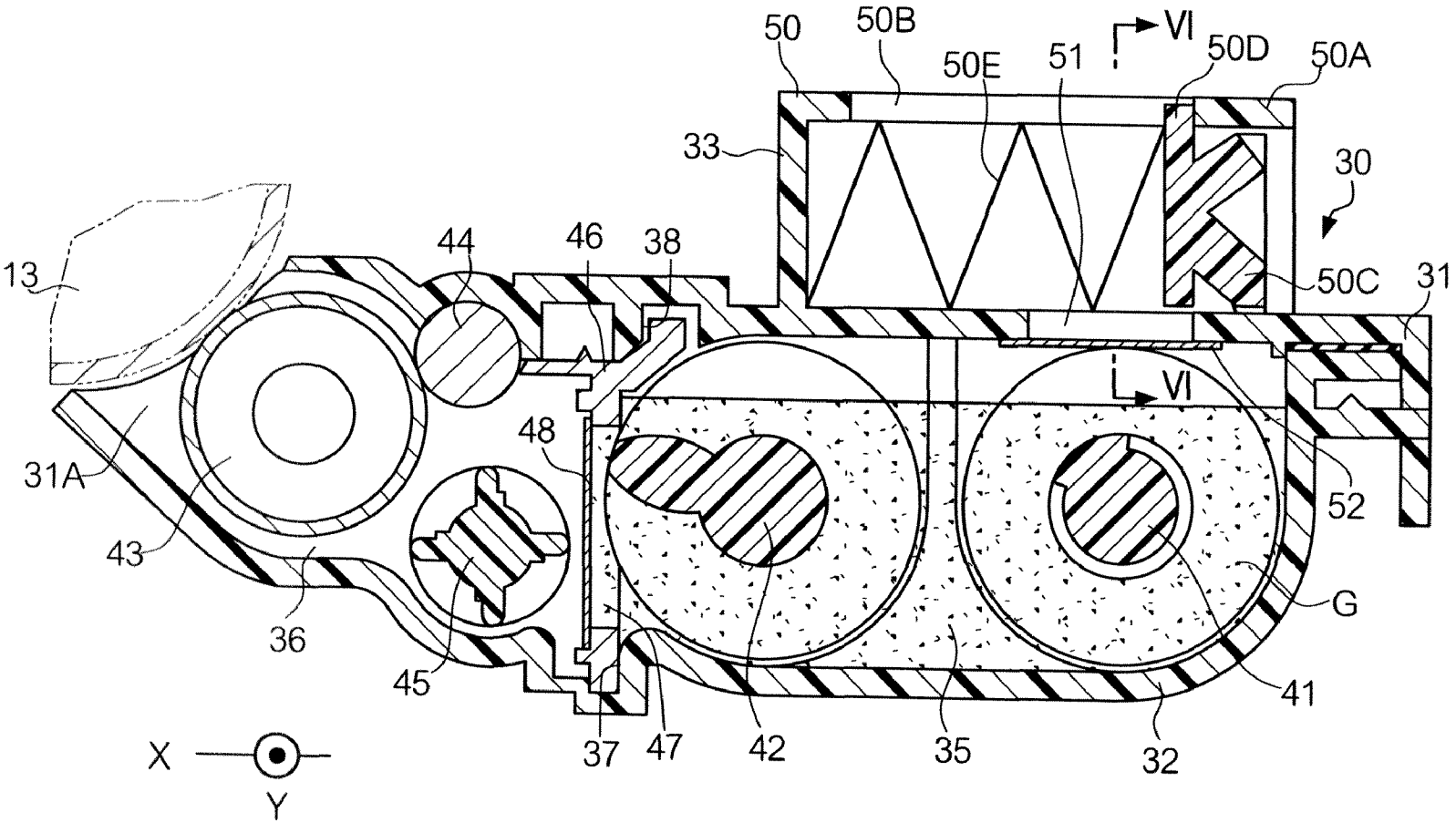
FIG. 4 is a partial cross-sectional view seen from a direction defined by arrows IV in FIG. 2.

FIGS. 2 to 4 are views showing a developing device 30 according to this exemplary embodiment. FIG. 2 is a perspective view of the developing device 30. FIG. 3 is an exploded perspective view of a main part of the developing device 30. FIG. 4 is a cross-sectional view seen from a direction defined by arrows IV in FIG. 2. In the description below, a widthwise direction and a lengthwise direction of the developing device 30 are X- and Y-axes, respectively.

As shown in FIGS. 2 and 3, the developing device 30 has a housing 31, an agitation auger 41, a feed auger 42, a magnetic roll 43, a trimmer member 44, and a paddle 45. The housing 31 includes an opening 31A and a chamber divided into a developer container part 35 and a developing part 36. The agitation auger 41 and feed auger 42 are located in the developer container part 35. The magnetic roll 43, trimmer member 44, and paddle 45 are located in the developing part 36.

A part of the magnetic roll 43 is exposed from the opening part 31A of the housing 31 and is located near the photo-sensitive drum 13. The trimmer member 44 regulates an amount of a developer held on a surface of the magnetic roll 43. A paddle 45 returns the developer released from the magnetic roll 43 after completion of development. Further, torque of a drive source is transmitted to the agitation auger 41, feed auger 42, magnetic roll 43, and paddle 45 through gears (none of which is shown in the figures).

The housing 31 is constituted of a lower housing 32, an upper housing 33, and side covers 34 arranged in the left and right sides of the upper and lower housings. The housing 31 is formed by assembling the parts 32 to 34, and is divided into the developer container part 35 and the developing part 36. A developer G is filled in the developer container part 35.

Further, as shown in FIG. 4, a groove is formed in the housing 31 at a position of a boundary between the developer container part 35 and the developing part 36. This groove is constituted of a lower groove 37 formed in the lower housing 32, an upper groove 38 formed in the upper housing 33, and the grooves formed in the side covers 34 which are omitted from the figure. When the developing device is not used, a partition frame 46 to which a sheet member 48 is bonded is engaged in the groove.

Meanwhile, a developer receiving part 50 is formed on one side of the upper housing 33 in the lengthwise direction.

The partition frame 46 and the sheet member 48 will now be described with reference to FIG. 5.

Figure 5:
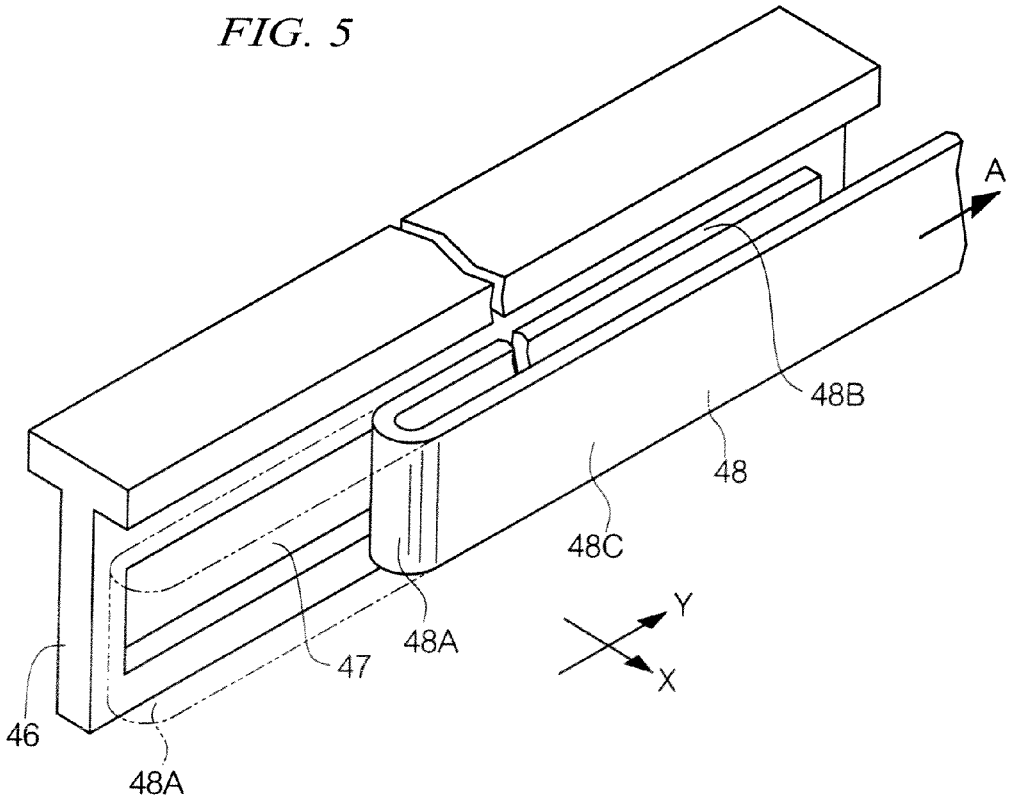
FIG. 5 is a perspective view showing a partition frame and a sheet member.

FIG. 5 shows a relationship between the partition frame 46 and the sheet member 48. The partition frame 46 has an outlet opening 47 through which the developer container part 35 and the developing part 36 communicate with each other. The outlet opening 47 communicates with the opening 31A (of the developing part 36) of the housing 31 through the developing part 36. As the sheet member 48 opens and/or closes, the developer container part 35 and the opening 31A (of the developing part 36) are connected to or disconnected to each other.

Further, the sheet member 48 is formed by layering a base layer and a thermal welding layer (both not shown). The base layer is formed, as a film having a thickness between 20 μm (micrometers) and 50 μm (micrometers), of polyester, polypropylene, polystyrene, or nylon. The thermal welding layer is formed as a film having a thickness between 20 μm (micrometers) and 40 μm (micrometers) of a polyethylene-based sealant, which contains ethylene vinyl acetate copolymer at several % to several ten %.

Further, the sheet member 48 is bonded, at the peripheries by an adhesive agent, to one side surface of the partition frame 46 so as to seal the outlet opening 47. The sheet member 48 is bonded so as to extend forward and return backward along a lengthwise direction (Y-axis) of the partition frame 46. Therefore, the sheet member 48 is twice as or more than twice as long as the developing device 30. A part of the sheet member 48, which is shown in a front side of FIG. 5 is a folded part 48A. A part of the sheet member 48 from a base end of the sheet member 48 to the folded part 48A is a forward part 48B which is bonded to the partition frame 46. A part of the sheet member 48 from the folded part 48A to a free end is a backward part 48C. This free end is led outside through a guide hole (not shown in the figures) formed between the upper housing 33 and the lower housing 32 and through a sheet path (not shown in the figures) in a side cover 34.

When separating the sheet member 48 off from the partition frame 46, the free end, which is led outside through the side cover 34 is pulled in a direction of an arrow A. The backward part 48C is pulled to the rear side in the figure, and the folding part 48A accordingly moves to the rear side. The rear side (in the figure) of the forward part 48B is accordingly separated from the partition frame 46. Thus, the sheet member 48 is separated from the partition frame 46 and the outlet opening 47 opens accordingly, thereby connecting the developer container part 35 to the developing part 36.

Figure 6:
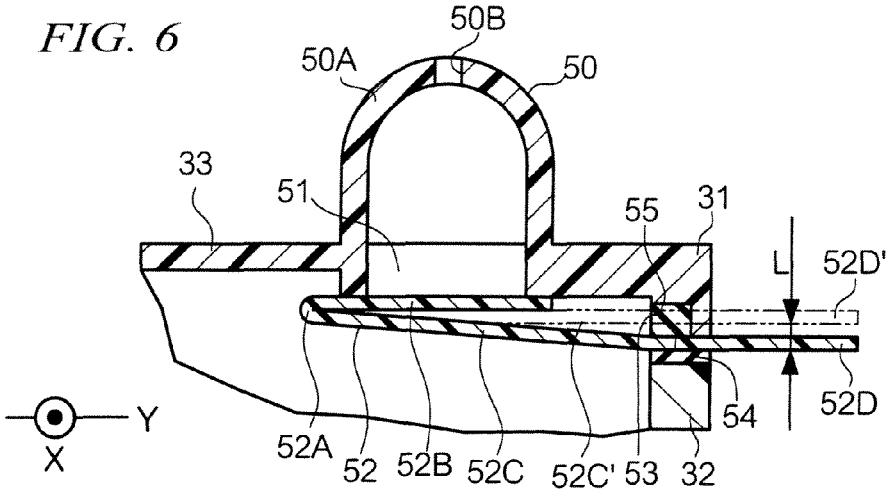
FIG. 6 is a partial cross-sectional view seen from a direction defined by arrows IV in FIG. 4.

Next, the structure of the developer receiving part 50 will now be described with reference to FIGS. 4 to 6. FIG. 6 is a cross-sectional view seen from a direction defined by arrows VI in FIG. 4.

The developer receiving part 50 is formed in a shape such as a half barrel on the upper housing 33. The developer receiving part 50 has an outer part 50A, a cover part 50C, and a spring 50E. The outer part 50A has a long regulation hole 50B formed extending in a lengthwise direction (X-axis direction) of the half barrel. A protrusion 50D to be engaged in the regulation hole 50B is protruded from the cover part 50C. The spring 50E presses the cover part 50C in a direction of closing the cover part 50C. An inlet opening 51 is formed at a position on the housing 31 where the developer receiving part 50 is formed.

Next, the developer receiving part 50 and a sheet member 52 will be described below. The sheet member 52 is bonded, at boundaries, to an inner surface of the upper housing 33 so as to seal the inlet opening 51. As shown in FIG. 6, the sheet member 52 has a folding part 52A in the left side of the figure. A part of the sheet member 52 from a base end to the folding part 52A is a forward part 52B, which is bonded to the peripheries of the inlet opening 51. A part of the sheet member 52 from the folding part 52A to a free end 52D is a backward part 52C. The free end 52D of the sheet member 52 is led outside through the guide hole 53 formed on the upper housing 33 and a seal member 54 bonded to the lower housing 32, and further through a sheet path (not shown in the figures) formed on the side covers 34.

The guide hole 53 is positioned on the lower housing 32 so that the backward part 52C of the sheet member 52 gradually separates off from the forward part 52B and from the folding part 52A toward the free end 52D. That is, a length L as a difference exists between the position of the guide hole 53 and a position defined by extending a free end 52D' to the outside. The free end 52D' is a position defined by extending a backward part 52C' just as the backward part 52C' extends, the backward part 52C' being a part which is folded back and overlaps the forward part 52B.

4. Features of the Exemplary Embodiment

With reference to prior descriptions of the features of the exemplary embodiment, the present inventor has researched and studied why the sheet members are cut while the sheet members are pulled out. That is, the folding part 52A of the sheet member 52 described above is positioned inside the developer container part 35. A developer G in the developer container part 35 is therefore caught in the folding part 52A of the sheet member 52 as the developer G is shaken and stirred during transportation, etc.

When using the developing device 30, a user starts pulling the sheet member 52 in a state as described above. If the developer G is caught in the folding part 52A the developer cannot escape and it forms a compacted lump by the pulling force, which prevents the sheet member 52 from being pulled out. When the user, however, continues pulling out the sheet member 52 even in this state, the sheet member gets cut due to being forcibly pulled out.

In order to solve the problem as described above, a flexible press plate (press unit) 81 that presses the free end side of the backward part 52C against the forward part 52B is provided in the developing device 30 according to this exemplary embodiment. Another press plate is provided for the sheet member 48, which seals the outlet opening 47. The latter press plate has the same structure and operates in the same manner as the former press plate 81; therefore, descriptions of the latter press plate will be omitted herefrom.

The press plate 81 has a base end 81A which is bonded and fixed to the inside of the lower housing 32 below the guide hole 53. A distal end 81B of the press plate 81 extends toward the upper housing 33 so as to press the backward part 52C against the forward part 52B.

The press plate 81 has a width, which is shorter than a width of the sheet member 52 and has a dimension of the inlet opening 51 in the X-axis direction. Further, the press plate 81 is made of a harder material than that of the sheet member 52. Accordingly, the press plate 81 presses the backward part 52C toward the forward part 52B, so that the backward part 52C is prevented from floating off of the forward part 52B, thereby reducing flexure of the backward part 52C. In addition, a part of the backward part 52C is bent by the force of pressing the press plate 81 against the backward part 52C. This bending of the backward part 52C in conjunction with the pressing force regulates easy movement of the sheet member 52.

In this manner, when the developing device 30 is not used, the developer is prevented from entering into the area between the backward part 52C and the forward part 52B and the area between the sheet member 52 and the upper housing 33.

Figure 7A:
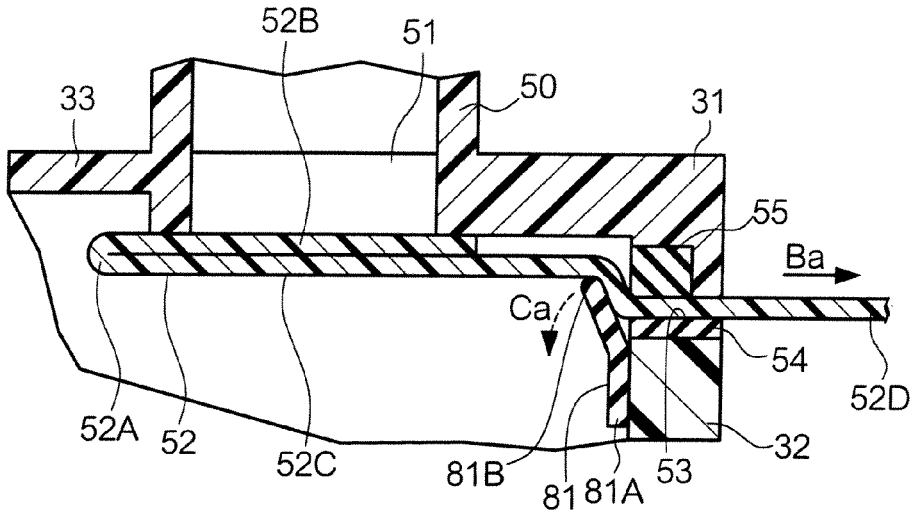
FIGS. 7A, 7B, and 7C are views illustrating a characteristic part of the exemplary embodiment.
Figure 7B:
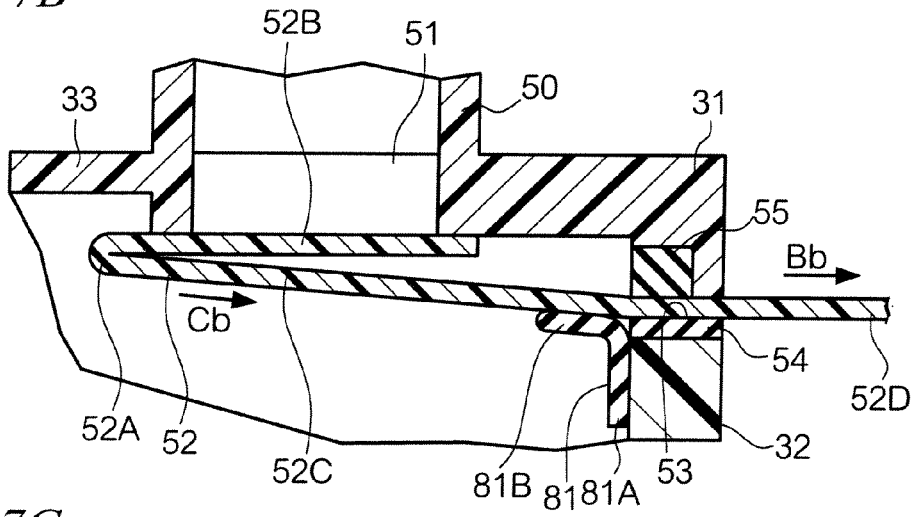

In case of using the developing device 30 attached to the base of the process cartridge 12, the user pulls the free end 52D in a direction of an arrow Ba when the sheet member 52 is pulled out. The backward part 52C is accordingly pulled, thereby applying a tension to the backward part 52C between the folding part 52A and the guide hole 53. When the tension is greater than the pressing force of the press plate 81, the distal end side 81B opens in a direction of an arrow Ca (FIG. 7A). Accordingly, the backward part 52C and forward part 52B of the sheet member 52 gradually separate from each other and from the folding part 52A toward the free end 52D (guide hole 53), thereby creating a gap in between (FIG. 7B). As a result, even when a developer is caught between the backward part 52C and the forward part 52B, the developer is removed through the gap created when the sheet member 52 is pulled out.

Figure 7C:
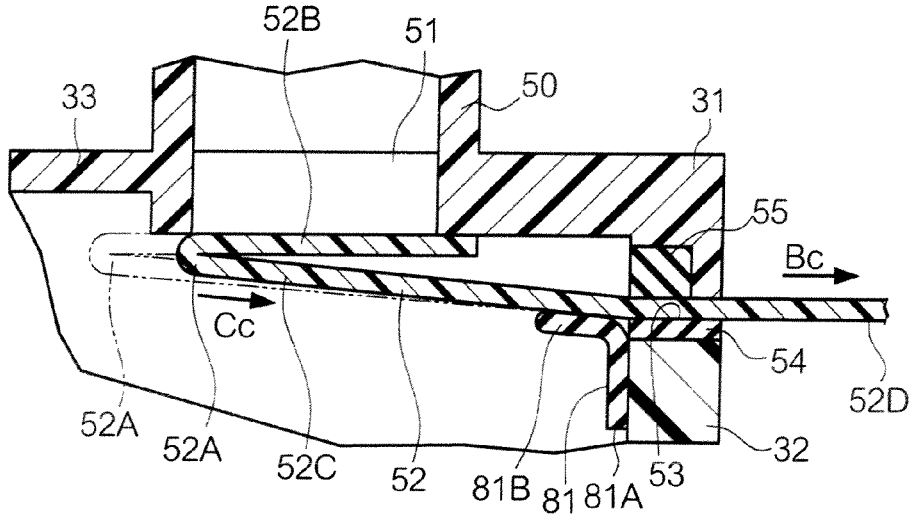

On the other hand, as the sheet member 52 is pulled in a direction of an arrow Bb, the backward part 52C is pulled in a direction of an arrow Cb, and the forward part 52B in the side of the folding part 52A accordingly starts separating from the peripheries of the inlet opening 51. Further, as shown in FIG. 7C, as the free end 52D of the sheet member 52 is hence pulled in the direction of the arrow Bc, the forward part 52B is separated while the folding part 52A moves in a direction of an arrow Cc. After the sheet member 52 is completely pulled out, the press plate 81 serves as a cover, which closes the guide hole 53 from the inside.

The operation as described above can be achieved by satisfying a relationship of E<F<G. In the relationship, E denotes a force corresponding to hardness (a spring constant) of the sheet member 52, F denotes a force corresponding to hardness (a spring constant) of the press plate 81, and G denotes a tension applied to the backward part 52C (between the folding part 52A and the guide hole 53). That is, the operation as described above is achieved if the tension G applied to the backward part 52C increases to satisfy F<G when a relationship of E<F is satisfied.

Thus, when the developing device 30 is not used, the press plate 81 presses the backward part 52C toward the forward part 52B, to prevent a gap from being created between the two parts. When the sheet member 52 is pulled out, the pressing of the backward part 52C toward the forward part 52B is released thereby creating a gap between the two parts. Accordingly, a developer is prevented from entering and staying in the sheet member 52, and the resistance, which may damage the sheet member 52, is prevented from being generated when the sheet member 52 is pulled out.

5. Modifications

The invention is not limited to the exemplary embodiment described above but is applicable in various other forms. For example, the invention may be configured in the modifications described below.

5-1. Modification 1

Figure 8A:
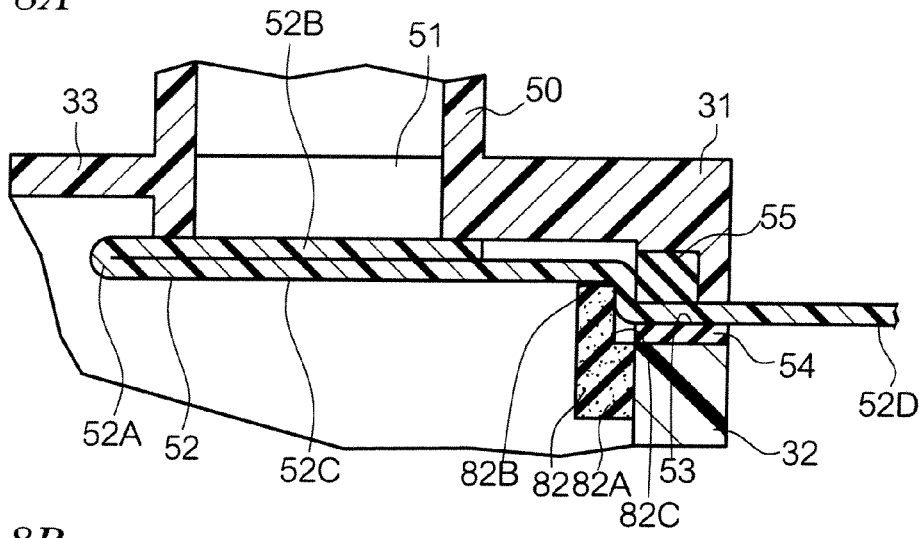
FIGS. 8A, 8B, and 8C are views illustrating a characteristic part of Modification 1.
Figure 8B:
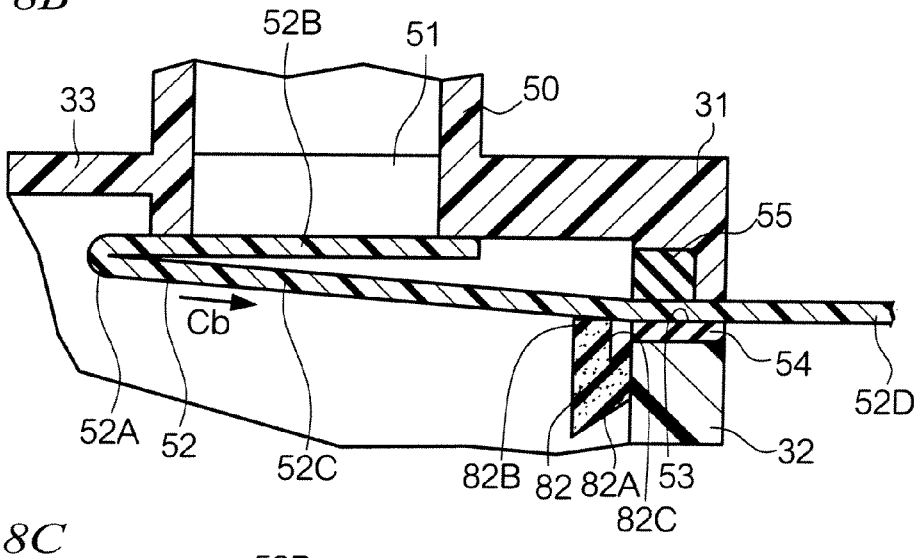
Figure 8C:
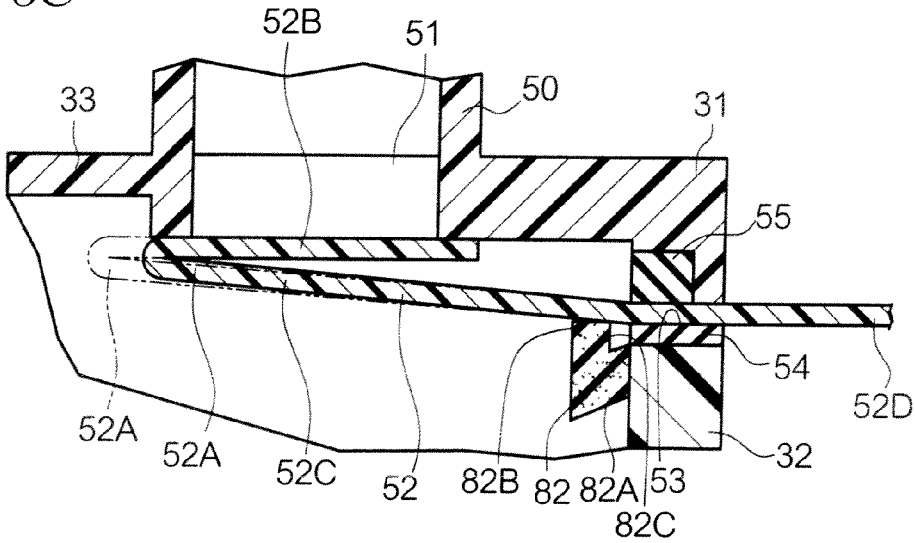

In Modification 1, a press member 82 is provided in place of the press plate 81 (see FIG. 8). The press member 82 is in the form of a rectangular column made out of a flexible elastic material (e.g., resin foam containing isolated bubbles).

The press member 82 has a base end 82A which is bonded and fixed to the inside of the lower housing 32*a* in a lower side of the guide hole 53. A distal end 82B extends toward the upper housing 33 in a manner that the distal end 82B presses the backward part 52C against the forward part 52B. A notch 82C is formed to afford thickness of the sheet member 52. However, the notch 82C may be omitted. The press member 82 presses the backward part 52C toward the forward part 52B as shown in FIG. 8A, and the backward part 52C is prevented from floating off of the forward part 52B, thereby reducing flexure. A part of the backward part 52C is bent by a force of pressing the press member 82 toward the backward part 52C. The bending of the backward part 52C in conjunction with the pressing force regulates easy movement of the sheet member 52.

On the other hand, when the sheet member 52 is pulled out as shown in FIG. 8B, the backward part 52C is pulled by pulling the free end 52D outside. Accordingly, a tension is applied to the backward part 52C between the folding part 52A and the guide hole 53. When the tension is greater than the pressing force of the press member 82, the press member 82 (distal end 82B) contracts, and the press member 82 is deformed. Accordingly, the backward part 52C of the sheet member 52 opens so as to gradually separate from the forward part 52B and from the folding part 52A toward the free end 52D (guide hole 53), thereby creating a gap (FIGS. 8A and 8B).

Thus, Modification 1 achieves the same functions as the exemplary embodiment.

5-2. Modification 2

5-2-1. Modification 2-1

Figure 9:
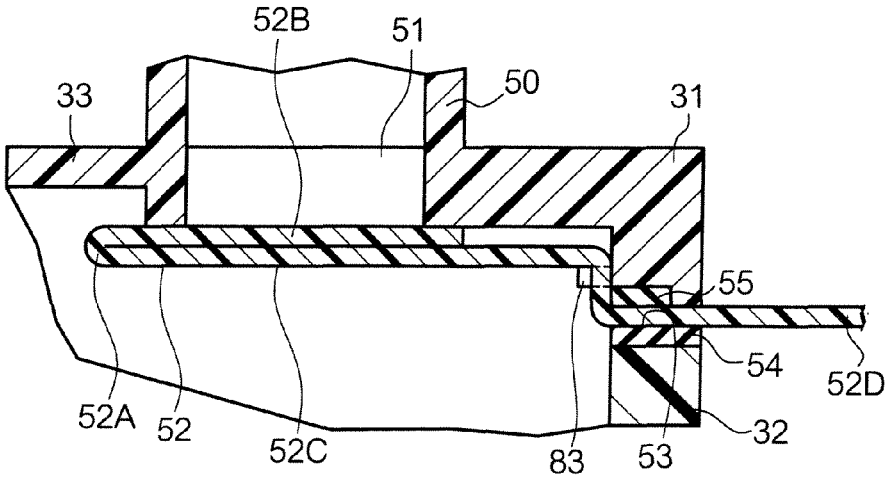
FIG. 9 is a view illustrating a characteristic part of Modification 2-1.

In Modification 2, a pair of clips 83 are provided in the upper housing 33 (see FIGS. 9 and 10). These clips 83 are provided inside the upper housing 33, in both sides in lengthwise directions of the guide hole 53, at positions closer to the developer receiving part 50 (not shown in FIG. 10) of the upper housing 33 than the guide hole 53. Each of the clips 83 are formed of a flexible plate material having a folded top end.

Figure 10B:
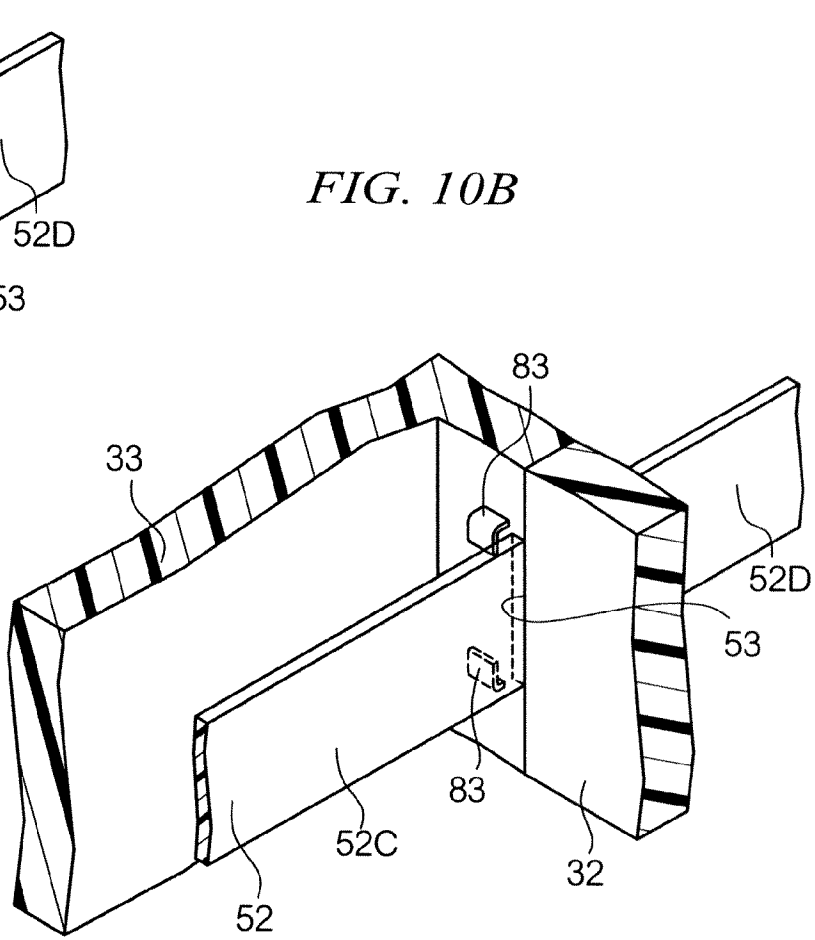
FIGS. 10A and 10B are views illustrating a characteristic part of Modification 2-1.
Figure 10A:
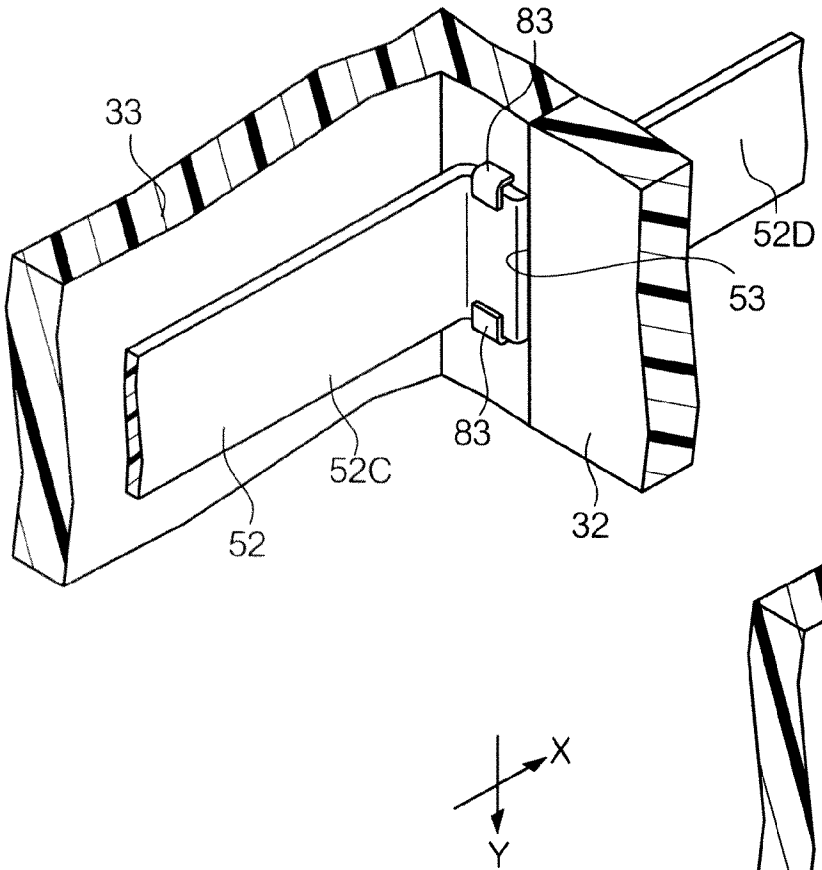

Further, when the developing device 30 is not used, the backward part 52C of the sheet member 52 is inserted into the guide hole 53 as shown in FIG. 10A. The backward part 52C is thereafter folded, and both ends of the sheet member 52 are clipped by the clips 83. Since the backward part 52C is folded, the backward part 52C is pressed toward the forward part 52B. Accordingly, the backward part 52C is prevented from floating off of the forward part 52B, thereby reducing flexure of the sheet member 52. Since the backward part 52C is clipped by the clips 83, the backward part 52C is folded and fixed temporarily, thereby regulating movement of the backward part 52C.

On the other hand, when the sheet member 52 is pulled out as shown in FIG. 10B, the backward part 52C is pulled by pulling the free end 52D outside. Accordingly, a tension is applied to the backward part 52C between the folding part 52A and the guide hole 53. When this tension is greater than the clipping force of the clips 83, the clips 83 instantaneously expand and release the backward part 52C, so that the backward part 52C is released.

As a result, the backward part 52C of the sheet member 52 opens so as to gradually separate from the forward part 52B and from the folding part 52A toward the free end 52D (guide hole 53), thereby creating a gap in between.

5-2-2. Modification 2-2

Figure 11:
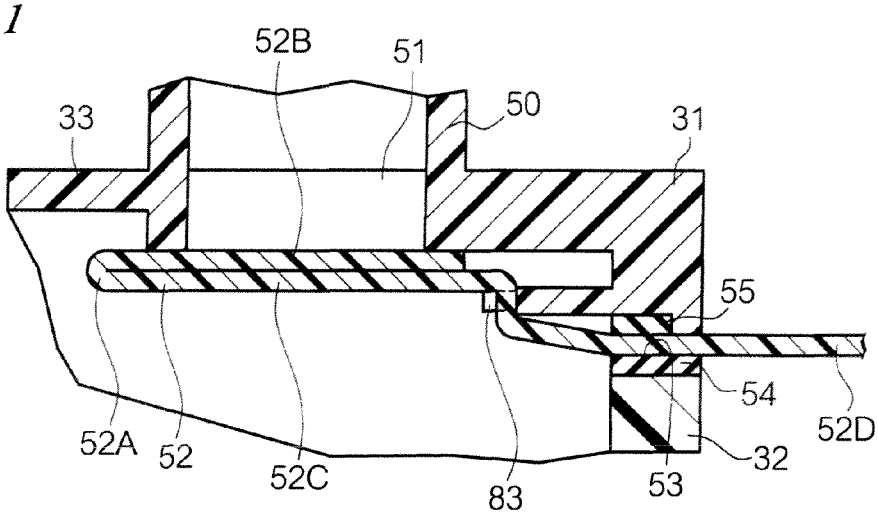
FIG. 11 is a view illustrating a characteristic part of Modification 2-2.

Alternatively, if there is a long distance between the opening and the guide hole, as shown in FIG. 11, a support projection 83A which extends toward the inlet opening 51 may be formed on the upper housing 33, and the clips 83 may be provided on both sides of the top end of the protrusion.

Further, the backward part 52C is clipped by the clips 83 of the protrusion 83A, so that the backward part 52C is pressed toward the forward part 52B. In addition, since the backward part 52C by the clips 83 is fixed near the inlet opening 51, the backward part 52C is more effectively prevented from floating off of the forward part 52B.

5-3. Modification 3

In Modification 3 a template 84 is provided for the backward part 52C of the sheet member 52 (see FIG. 12). The template 84 is inserted into the guide hole 53 along with the sheet member 52. The template 84 is made of a material, which is harder than that of the sheet member 52. A part 84A where a top end of the template in a lengthwise direction of the temperate is L-folded has a length corresponding to the length L (see FIG. 6).

Figure 12B:
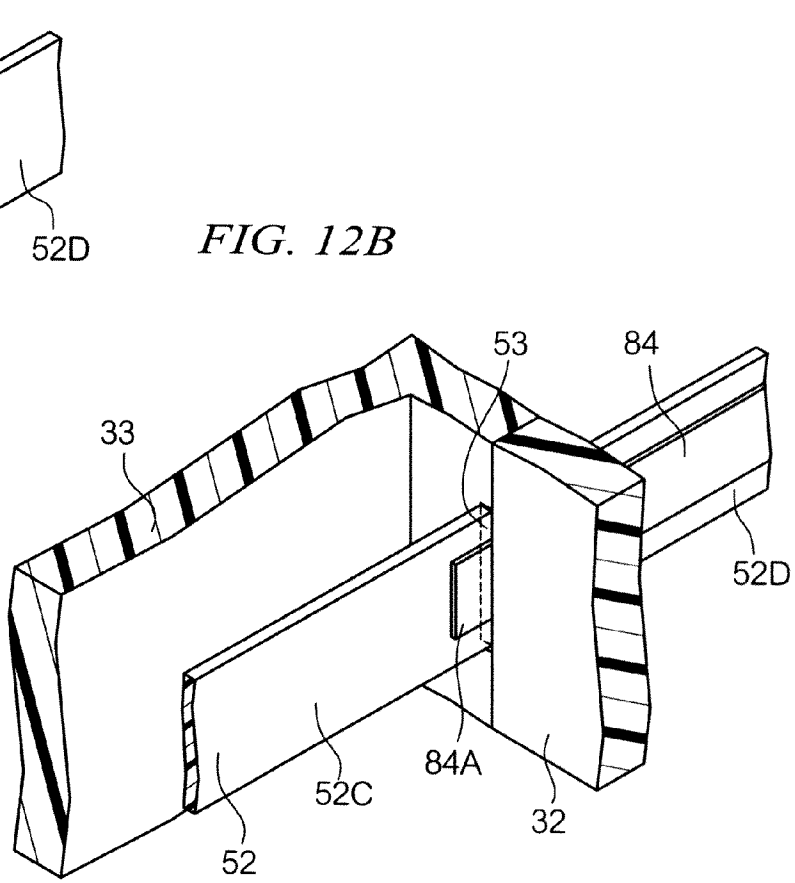
FIGS. 12A and 12B are views illustrating a characteristic part of Modification 3.
Figure 12A:
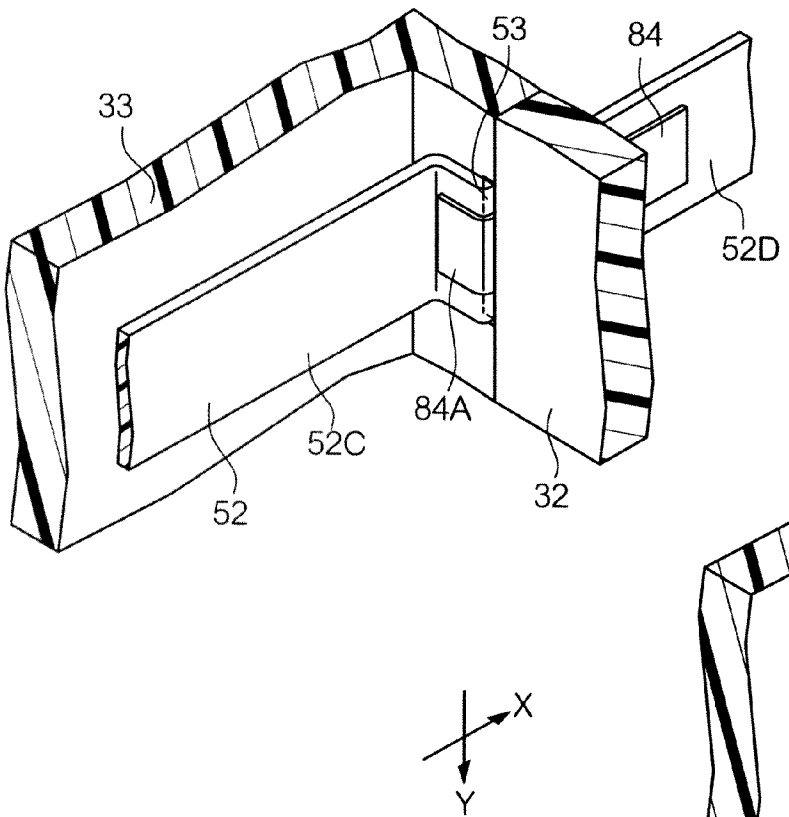

When the developing device 30 is not used, the backward part 52C of the sheet member 52 is inserted into the guide hole 53 along with the template 84, as shown in FIG. 12A. The template 84 is further inserted until the part 84A of the template 84 touches an inner surface of the upper housing 33 and folds the backward part 52C. In this manner, the backward part 52C is folded and is pressed toward the forward part 52B as in the other modifications. The backward part 52C is thereby prevented from floating off of the forward part 52B.

On the other hand, when the sheet member 52 is pulled out as shown in FIG. 12B, the template 84 is pulled by pulling the free end 52D outside. A part folded by the part 84A accordingly passes through the guide hole 53, thereby releasing the folded part. As a result, the backward part 52C of the sheet member 52 opens so as to gradually separate from the forward part 52B and from the folding part 52A toward the free end 52D (guide hole 53), thereby creating a gap between the forward part 52B and the backward part 52C.

The template 84 may be bonded in advance to the sheet member 52 or may be simply inserted into the guide hole 53, layered on the sheet member 52.

5-4. Modification 4

In Modification 4, a press plate 85, which presses a part of the backward part 52C against the upper housing 33 is provided. The press plate 85 is inserted and positioned in an insertion hole (not shown in the figures) formed in the housing 31, and can be pulled out from the outside.

Figures 13A, 13B:
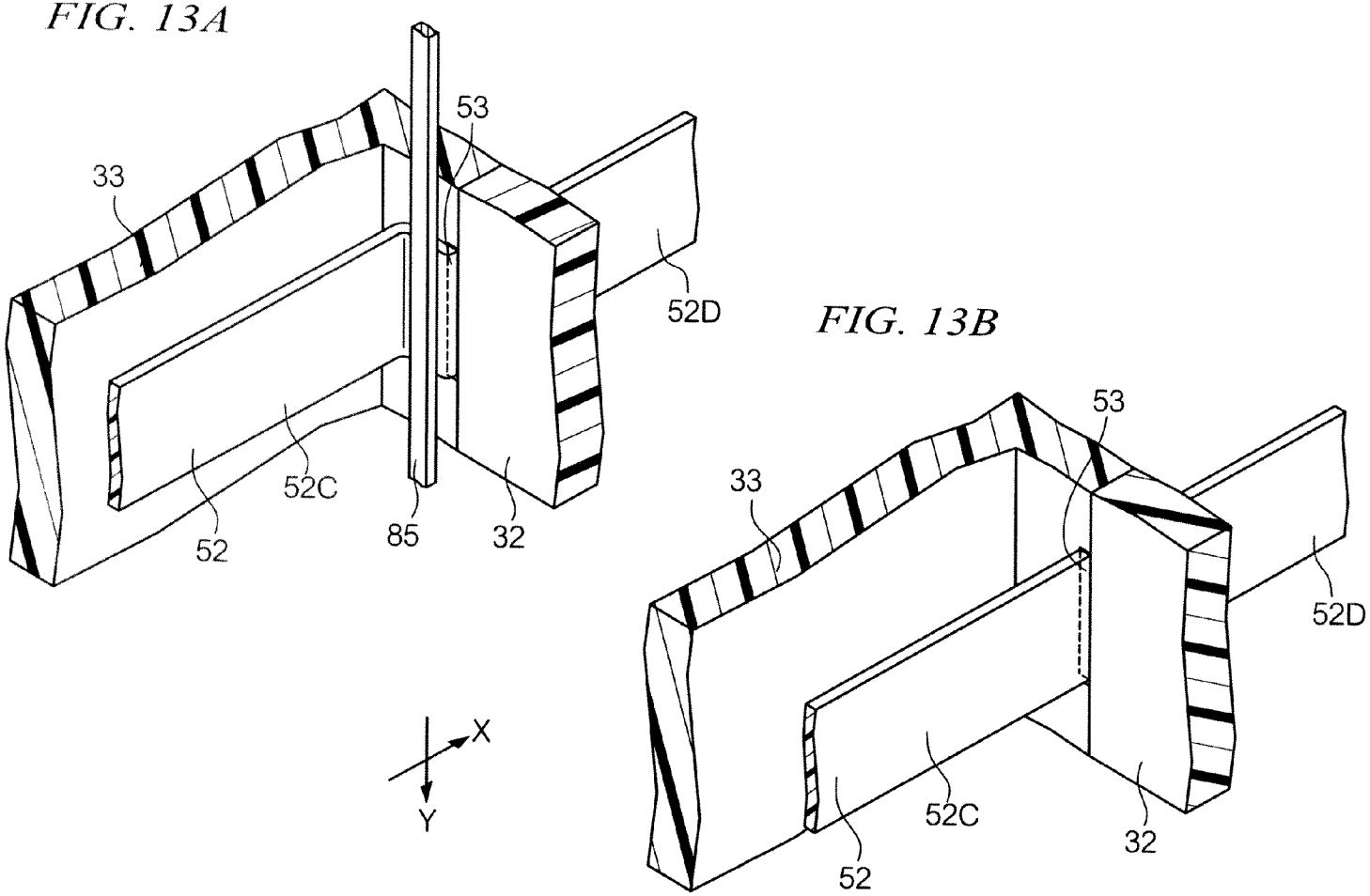
FIGS. 13A and 13B are views illustrating a characteristic part of Modification 4.
Figure 14:
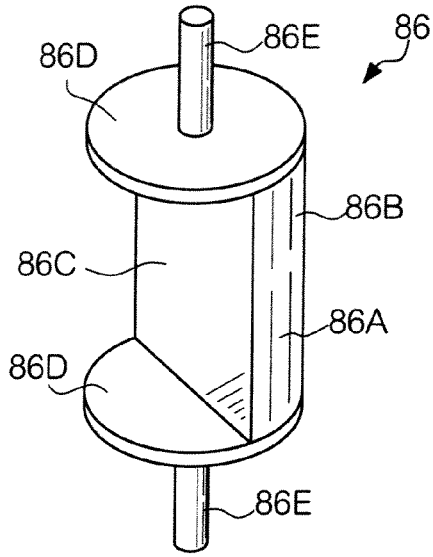
FIG. 14 is a view illustrating a characteristic part of Modification 5.

When the developing device 30 is not used, the backward part 52C of the sheet member 52 is inserted into the guide hole 53, as shown in FIG. 13A. Thereafter, the press plate 85 is inserted into the insertion hole to press the backward part 52C against the inside of the upper housing 33. A part of the backward part 52C is folded by the press plate 85, and the backward part 52C is prevented from floating off of the forward part 52B.

On the other hand, when the sheet member 52 is pulled out as shown in FIG. 13B, the press plate 85 is pulled out to release the backward part 52C from being pressed against the upper housing 33. Accordingly, the backward part 52C of the sheet member 52 opens so as to gradually separate from the forward part 52B and from the folding part 52A toward the free end 52D (guide hole 53), thereby creating a gap between the forward part 52B and the backward part 52C.

5-5. Modification 5

In Modification 5, there is provided a press valve 86 which presses the backward part 52C of the sheet member 52 against the forward part 52B and releases the pressed backward part 52C when the sheet member 52 is pulled out. The press valve 86 is formed by cutting away a part from a circular column. The press valve 86 has a body part 86A, flanges 86S, and axle parts 86E. The body part has a circumferential surface as a pressing surface 86B, and a cut-away surface as a release surface 86C. The flanges 86D are formed on both sides of the body part 86A. The axle parts 86E are protruded outside from the centers of the flanges 86D. The axle parts 86E of the press valve 86 are supported by a bracket, which is formed on the housing 31 (not shown in the figures).

Figure 15A:
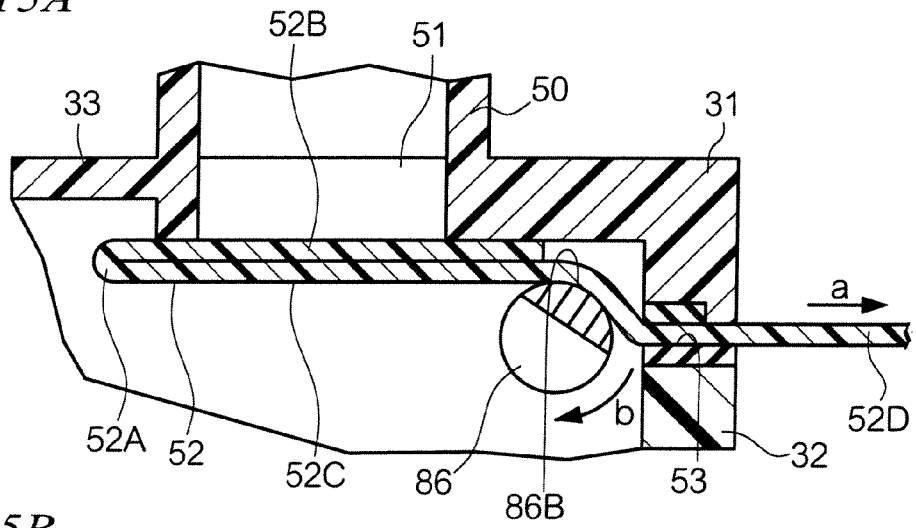
FIGS. 15A and 15B are views illustrating a characteristic part of Modification 5.
Figure 15B:
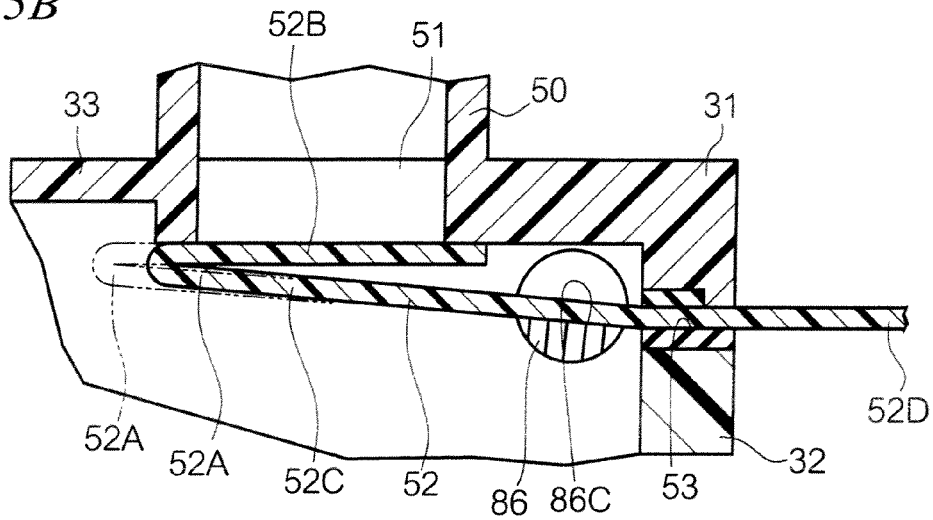

When the developing device 30 is not used, the backward part 52C of the sheet member 52 is inserted into the guide hole 53, as shown in FIG. 15A. The press valve 86 is thereafter rotated so that the pressing surface 86B touches the backward part 52C. As a result, the backward part 52C is pressed toward the forward part 52B, thereby preventing the backward part 52C from floating off of the forward part 52B.

On the other hand, when the sheet member 52 is pulled out, the free end 52D is pulled in a direction of an arrow a. Then, the folding part 52A moves with the backward part 52C kept pressed against the forward part 52B. Accordingly, the forward part 52B starts separating, and the backward part 52C moves in the direction of the arrow a. In accordance with the movement described above, the pressing surface 86B, which touches the backward part 52C moves, and the press valve 86 rotates in a direction of an arrow b. If the sheet member 52 is continuously pulled from this state, the backward part 52C pressed by the pressing surface 86B is released, and is brought into contact with the release surface 86C. At this time, pressing of the press valve 86 against the forward part 52B is released. Therefore, the backward part 52C of the sheet member 52 opens so as to gradually separate from the forward part 52B and from the folding part 52A toward the free end 52D (i.e., the guide hole 53), thereby creating a gap between the forward part 52B and the backward part 52C.

Modification 5 has exemplified a case of using a press valve 86 having a shape in which the pressing surface 86B and the release surface 86C are formed by cutting away a part from a circular column. However, the invention is not limited to this case but the press valve 86 may have any other shape insofar as the press valve 86 is configured as follows. That is, the backward part 52C needs to be pressed against the forward part 52B when the developing device 30 is not used. The pressed backward part 52C needs to be released when the sheet member 52 is pulled out.

For example, the press valve 86 may have an oval or elliptical cross-section. When not used, a part of the press valve 86 having a large radius may be in contact with the backward part 52C, and the forward part 52B may be pressed against the forward part 52B. When the sheet member 52 is being pulled out, a part having a shorter radius may be in contact with the backward part 52C, and the backward part 52C pressed against the forward part 52B may be released.

Further, the valve is rotated to press or release the backward part 52C in relation to the forward part 52B. However, the invention is not limited to this configuration but the backward part 52C may be pressed by a spring or the like. In this case, a spring force H needs only to satisfy a relationship of $E<H$ where E denotes a force corresponding to the hardness (spring constant) of the sheet member 52.

5-6. Modification 6

The foregoing Modifications 3 to 5 have exemplified a case that the distance from the opening to the guide hole is relatively short. If the distance is long, the support protrusion 83A may be formed so as to protrude as in the Modification 2-2. The press unit may be located so that a part of the backward part 52C is bent with respect to the support protrusion 83A.

5-7. Modification 7

The foregoing exemplary embodiment and modifications have exemplified a case of using a press unit in the developing device 30. Needless to say, however, the invention is not limited to this case but may be applied to a developer container, which has a developer container part in which a sheet member is used to seal an opening.

5-8. Modification 8

The foregoing exemplary embodiment has been described with reference to a case that a developing device is attached to a process cartridge after a user pulls out a sheet member from the developing device. However, the developing device according to the invention is applicable to a process cartridge having a mechanism, which automatically pulls out a sheet member after the process cartridge is attached to a developing device not used (from which the sheet member is not yet pulled out).

What is claimed is:

1. A developing device comprising:

a housing having a developer container part and an opening, the developer container part containing a developer, and the opening allowing the developer to flow through;

a developer carrier that is rotatably attached to the housing, and holds and carries the developer contained in the developer container part to a developing area facing the image carrier;

a sheet member that is provided on the housing and seals the opening when not used, and is pulled out in one direction to open the opening when used, the sheet member being folded back toward the opening and sealing the opening, the sheet member including a forward part and a backward part, the forward part extending from a base end to a folded part of the sheet member, and the backward part extending in the one direction from the folded part to a free end as a top end of the sheet member, protruding to the outside of the housing; and a press unit that presses the backward part of the sheet member toward the forward part when not used, wherein the housing has a guide hole, the guide hole being formed in a position of the housing where the backward part of the sheet member gradually separates off from the forward part and from the folded part to the free end, the backward part of the sheet member being inserted into the guide hole when not used, and the sheet member being guided by the guide hole when the sheet member is pulled out.

2. The developing device according to claim 1, wherein the press unit releases the backward part pressed toward the forward part when the sheet member is pulled out.

3. The developing device according to claim 1, wherein the press unit is formed of a harder plate material than the sheet member and deforms in deflective.

4. The developing device according to claim 1, wherein the press unit is formed of a harder member than the sheet member and deforms in stretch.

5. The developing device according to claim 1, wherein the press unit temporarily fixes the backward part when not used, and releases the backward part fixed in a side of the free end, when the sheet member is pulled out.

6. The developing device according to claim 1, wherein the press unit has a mechanism that presses the backward part toward the forward part and releases the backward part pressed toward the forward part when the sheet member is pulled out.

7. A process cartridge comprising:

an image carrier having a surface on which an electrostatic latent image is formed; and a developing device including:

a housing having a developer container part and an opening, the developer container part containing a developer, and the opening allowing the developer to flow through;

a developer carrier that is rotatably attached to the housing, and holds and carries the developer contained in the developer container part to a developing area facing the image carrier;

a sheet member that is provided on the housing and seals the opening when not used, and is pulled out in one direction to open the opening when used, the sheet member being folded back toward the opening and sealing the opening, the sheet member including a forward part and a backward part, the forward part extending from a base end to a folded part of the sheet member, and the backward part extending in the one direction from the folded part to a free end as a top end of the sheet member, protruding to the outside of the housing; and a press unit that presses the backward part of the sheet member toward the forward part when not used, wherein the housing has a guide hole, the guide hole being formed in a position of the housing where the backward part of the sheet member gradually separates off from the forward part and from the folded part to the free end, the backward part of the sheet member being inserted into the guide hole when not used, and the sheet member being guided by the guide hole when the sheet member is pulled out, wherein the developing device visualizes, by the developer, the electrostatic latent image formed on the surface of the image carrier.

8. An image forming device comprising:

an image carrier having a surface on which an electrostatic latent image is formed;

a developing device including:

a housing having a developer container part and an opening, the developer container part containing a developer, and the opening allowing the developer to flow through;

a developer carrier that is rotatably attached to the housing, and holds and carries the developer contained in the developer container part to a developing area facing the image carrier;

a sheet member that is provided on the housing and seals the opening when not used, and is pulled out in one direction to open the opening when used, the sheet member being folded back toward the opening and sealing the opening, the sheet member including a forward part and a backward part, the forward part extending from a base end to a folded part of the sheet member, and the backward part extending in the one direction from the folded part to a free end as a top end of the sheet member, protruding to the outside of the housing; and a press unit that presses the backward part of the sheet member toward the forward part when not used, wherein the housing has a guide hole, the guide hole being formed in a position of the housing where the backward part of the sheet member gradually separates off from the forward part and from the folded part to the free end, the backward part of the sheet member being inserted into the guide hole when not used, and the sheet member being guided by the guide hole when the sheet member is pulled out, wherein the developing device visualizes, by the developer, the electrostatic latent image formed on the surface of the image carrier;

a latent image forming unit that forms the electrostatic latent image on the surface of the image carrier; and a transfer unit that transfers a toner image to a recording medium, the toner image being formed by visualizing the electrostatic latent image by the developing device.

9. A developer container comprising:

a housing having a developer container part and an opening, the developer container part containing a developer, and the opening allowing the developer to flow through;

a sheet member that is provided on the housing, seals the opening when the developer container is not used, and is pulled out in one direction to open the opening when used, the sheet member being folded back toward the opening and sealing the opening, the sheet member including a forward part and a backward part, the forward part extending from a base end to a folded part of the sheet member, and the backward part extending in the one direction from the folded part to a free end as a top end, protruding to the outside of the housing; and a press unit that temporarily presses the backward part of the sheet member toward the forward part when the developer container is not used, and releases the backward part pressed toward the backward part when the sheet member is pulled out, wherein the housing has a guide hole, the guide hole being formed in a position of the housing where the backward part of the sheet member gradually separates off from the forward part and from the folded part to the free end, the backward part of the sheet member being inserted into the guide hole when the developer container is not used, and the sheet member being guided by the guide hole when the sheet member is pulled out.

* * * * *